US005873699A

United States Patent [19]

Watson et al.

[11] Patent Number: 5,873,699

[45] Date of Patent: Feb. 23, 1999

[54] DISCONTINUOUSLY REINFORCED ALUMINUM GAS TURBINE GUIDE VANE

[75] Inventors: Thomas J. Watson, Palm Beach Gardens, Fla.; Vincent C. Nardone, South Windsor, Conn.; John A. Visoskis, Vernon, Conn.; Stuart A. Anderson, South Windsor, Conn.

[73] Assignee: United Technologies Corporation, Hartford, Conn.

[21] Appl. No.: 670,302

[22] Filed: Jun. 27, 1996

[51] Int. Cl.[6] ..... F01D 1/02

[52] U.S. Cl. ..... 415/200; 416/223 A; 416/232; 416/229 R; 416/229 A

[58] Field of Search ..... 416/231 R, 232, 416/241 R, 241 B, 229 B, 229 A, 233, 223 A; 415/200

[56] References Cited

U.S. PATENT DOCUMENTS

| | | | |
|---|---|---|---|
| 5,015,534 | 5/1991 | Kampe et al. | 428/570 |
| 5,511,603 | 4/1996 | Brown et al. | 164/97 |
| 5,560,991 | 10/1996 | Patel et al. | 428/367 |

*Primary Examiner*—Thomas E. Denion
*Attorney, Agent, or Firm*—Richard D. Getz

[57] ABSTRACT

An airfoil is provided having a cross-sectional geometry which includes a first wall, a second wall disposed opposite the first wall, a leading edge, a trailing edge disposed opposite the leading edge, and a first cavity. The first cavity is disposed between the first and second walls, and the leading and trailing edges. The cross-sectional geometry extends between a first and a second end, and the airfoil is formed from discontinuously reinforced aluminum.

18 Claims, 1 Drawing Sheet

DISCONTINUOUSLY REINFORCED ALUMINUM GAS TURBINE GUIDE VANE

BACKGROUND OF THE INVENTION

1. Technical Field

This invention applies to gas turbine engines in general, and to guide vanes for use in gas turbine engines in particular.

2. Background Information

Airfoils disposed aft of a rotor section within a gas turbine engine help direct the gas displaced by the rotor section in a direction chosen to optimize the work done by the rotor section. These airfoils, commonly referred to as "guide vanes", are radially disposed between a hub and an outer casing, spaced around the circumference of the rotor section. Historically, guide vanes were fabricated from conventional aluminum as solid airfoils. The solid cross-section provided the guide vane with the stiffness required to accommodate the loading caused by the impinging gas and the ability to withstand an impact from a foreign object.

"Gas path loading" is a term of art used to describe the forces applied to the airfoils by the gas flow impinging on the guide vanes. The magnitudes and the frequencies of the loading forces vary depending upon the application and the thrust produced by the engine. If the frequencies of the forces coincide with one or more natural frequencies of the guide vane (i.e., a frequency of a bending mode of deformation and/or a frequency of a torsional mode of deformation), the forces could excite the guide vane into an undesirable vibratory response.

A significant disadvantage of conventional guide vanes made from solid aluminum is the cumulative weight of the guide vanes. Gas turbine design places a premium on minimizing the weight of engine components because increasing the weight of an engine negatively affects the engine's thrust to weight ratio. Hollow guide vanes made from conventional aluminum avoid the weight problem of the solid guide vanes, but lack the stiffness and fatigue strength necessary for high thrust applications. This limitation is particularly problematic in modern gas turbine engines where the trend has been to increase the fan diameter of the engine to produce additional thrust. Increasing the thrust of an engine generally increases the loading on the guide vanes, particularly those in the fan section when the fan diameter is increased. An additional problem with hollow guide vanes made of conventional aluminum is that some of the more desirable conventional aluminum alloys cannot be extruded into the cross-sectional geometry required of a guide vane.

More recently, guide vanes have been produced from polymer matrix composite materials, or "PMC's". PMC's are attractive because they are significantly lighter than conventional aluminums, possess the requisite stiffness, and can be formed into a variety of complex geometries. A disadvantage of PMC guide vanes is the cost of producing them, which is significantly more than that of similar guide vanes made from conventional aluminum. Like weight, cost is of paramount importance. Another disadvantage of PMC guide vanes is their durability. Conventional aluminum guide vanes have an appreciable advantage in average life cycle duration over PMC guide vanes. Shorter life cycles not only require greater maintenance, but also exacerbate the difference in cost between the two materials.

In short, what is needed is a guide vane that possesses adequate stiffness and fatigue strength to accommodate loadings present in high thrust engines, one that possesses adequate stiffness and fatigue to accommodate foreign object strikes, one that is lightweight, one that is relatively inexpensive to manufacture, and one that can be readily manufactured.

DISCLOSURE OF THE INVENTION

It is, therefore, an object of the present invention to provide a lightweight airfoil that possesses adequate stiffness and fatigue strength to accommodate loadings present in high thrust engines.

It is another object of the present invention to provide an airfoil that is relatively inexpensive to manufacture.

It is still another object of the present invention to provide an airfoil that can be readily manufactured.

According to the present invention, an airfoil is provided having a cross-sectional geometry which includes a first wall, a second wall disposed opposite the first wall, a leading edge, a trailing edge disposed opposite the leading edge, and at least one cavity. The cavity is disposed between the first and second walls, and the leading and trailing edges. The cross-sectional geometry extends between a first and a second end, and the airfoil is formed from Discontinuously Reinforced Aluminum (DRA).

The present invention provides several significant advantages over existing airfoils. One advantage lies in the increased stiffness possible with the present invention. Stiffness of a body is generally a function of the material of the body and the cross-sectional geometry of the body. The following equation may be used to describe the relationship mathematically:

$$S=EIf(x,L)$$

where "S" represents stiffness (lbs/in), "E" represents the modulus of elasticity for the material (lbs/in$^2$), "I" represents the area moment of inertia (in$^4$), and "x" is a function of position within the body and "L" the length of the body, for a body of uniform cross-section. Most conventional aluminum alloys have an "E" value in the range of 9.9–10.3 ($\times 10^6$) lbs/in$^2$. DRA's, on the other hand, have "E" values in the range of 14.0–17.0 ($\times 10^6$) lbs/in$^2$. Hence, an airfoil formed from a DRA material possesses a greater stiffness than one made from a conventional aluminum alloy having the same cross-section.

PMC's used to form airfoils possess "E" values greater than those of conventional aluminum alloys, but have mechanical properties that vary as a function of orientation. In one direction, for example, a PMC specimen may have an "E" value of 14.0 to 15.0 ($\times 10^6$) lbs/in$^2$, which is significantly higher than that of conventional aluminum. In a transverse direction, however, the "E" value of the specimen may be as low as 4 or 5 ($\times 10^6$) lbs/in$^2$, thereby limiting the applications for which PMC's are suitable. The isotropic mechanical properties of DRA avoid this problem.

Another advantage of the present invention is that a high stiffness airfoil is provided which can be readily manufactured. One of the preferred methods for forming a metallic airfoil is extrusion. In the case of hollow airfoils, the material being extruded separates while passing the die and welds back together again aft of the die. Not all conventional aluminum alloys are amenable to this type forming, and those that are do not always possess the stiffness or the fatigue strength required for service in high thrust gas turbine engines. DRA's will rejoin aft of an extrusion die, but are much more difficult to extrude than conventional aluminums. The present invention provides the means to extrude intricate geometries with DRA's, thereby enabling an airfoil to be manufactured from DRA.

Another advantage provided by the present invention is a cost savings. PMC airfoils, which possess nearly the same stiffness as hollow DRA airfoils and are approximately the same weight, are considerably more expensive than hollow DRA airfoils. In addition, the average life cycle of PMC airfoils is appreciably less than that of hollow DRA airfoils, thereby necessitating more frequent replacement which exacerbates the cost difference.

These and other objects, features and advantages of the present invention will become apparent in light of the detailed description of the best mode embodiment thereof, as illustrated in the accompanying drawings.

BEST MODE FOR CARRYING OUT THE INVENTION

Figure 1:
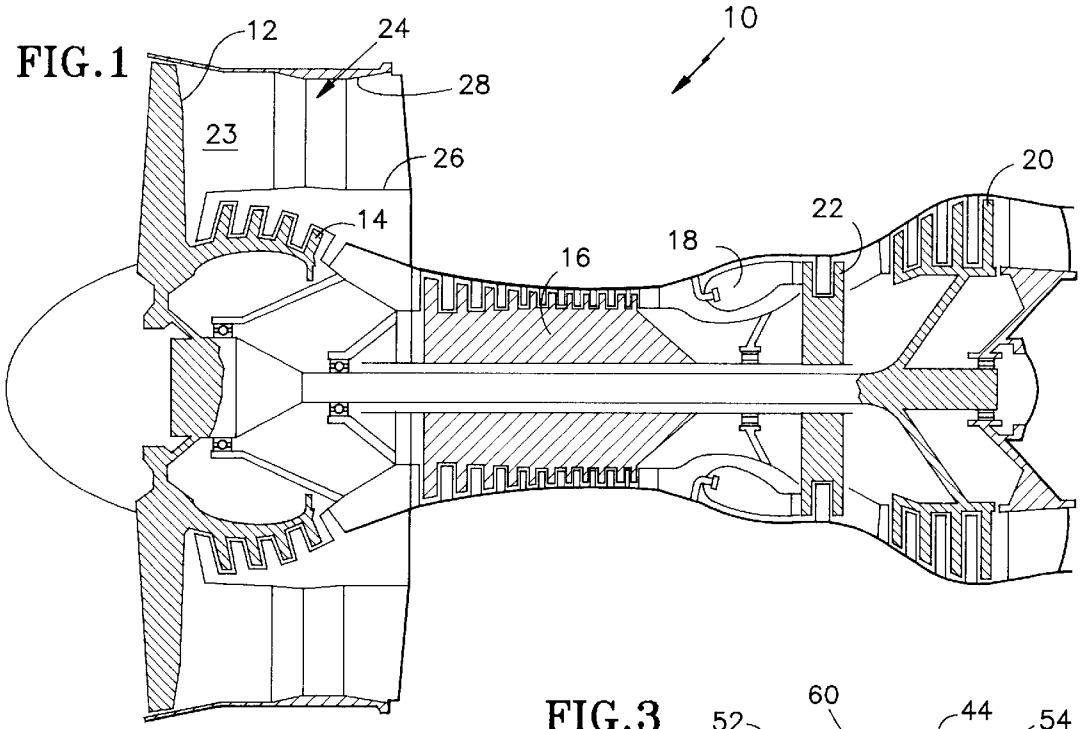
FIG. 1 is a diagrammatic cross-section of a gas turbine engine.

Referring to FIG. 1, a gas turbine engine 10 includes a fan section 12, a low pressure compressor 14, a high pressure compressor 16, a combustor 18, a low pressure turbine 20, and a high pressure turbine 22. The fan section 12 and the low pressure compressor 14 are connected to one another and are driven by the low pressure turbine 20. The high pressure compressor 16 is driven by the high pressure turbine 22. Air worked by the fan section 12 will either enter the low pressure compressor 14 as "core gas flow" or will enter a passage 23 outside the engine core as "bypass air". Bypass air exiting the fan section 12 travels toward and impinges on a plurality of fan exit guide vanes 24, or "FEGV's", disposed about the circumference of the engine 10. The FEGV's 24 guide the bypass air into ducting (not shown) disposed outside the engine 10.

Figure 2:
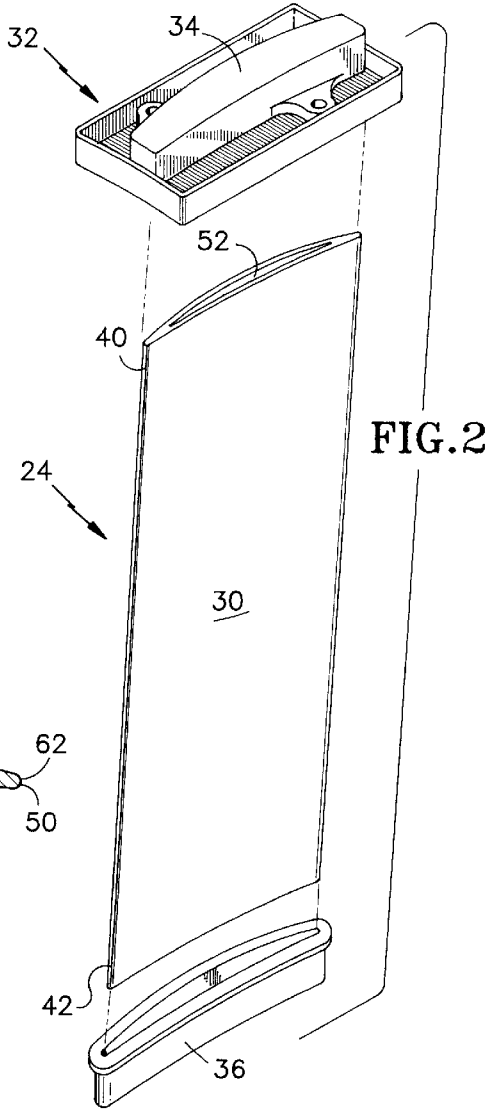
FIG. 2 is a exploded view of a fan exit guide vane.

Now referring to FIGS. 1 and 2, the FEGV's 24 extend between fan inner 26 and outer cases 28. The inner case 26 is disposed radially between the low pressure compressor 14 and the FEGV's 24 and the outer case 26 is disposed radially outside of the FEGV's 24. Each FEGV 24 includes an airfoil 30 and means 32 for securing the airfoil 30 between the inner and outer cases 26,28. In the example shown in FIG.2, the means 32 for securing includes a first bracket 34 and a second bracket 36. Other embodiments of the means 32 for securing may be used alternatively.

Figure 3:
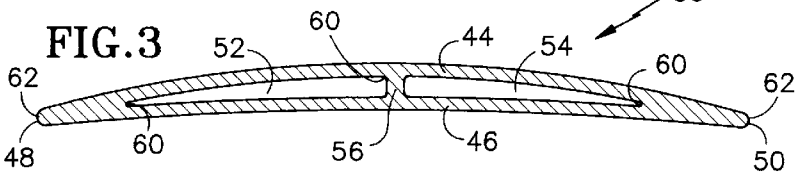
FIG. 3 is a cross-section of a guide vane similar to that shown in FIG. 2, having two cavities.
Figure 4:
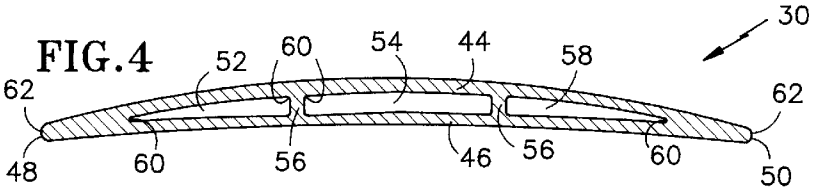
FIG. 4 is a cross-section of a guide vane similar to that shown in FIG. 2, having three cavities.

Referring to FIGS. 2–4, the airfoil 30 includes a mono-piece cross-sectional geometry that extends from a first end 40 to a second end 42 (FIG.2). The cross-sectional geometry includes a first wall 44, a second wall 46, a leading edge 48, a trailing edge 50, and cavity(ies) 52. The second wall 46 is disposed opposite the first wall 44 and the trailing edge 50 is disposed opposite the leading edge 48. The cavity(ies) 52 is disposed between the first and second walls 44,46, and the leading and trailing edges 48,50. FIG.2 shows a single cavity 52. FIG.3 shows a first 52 and second 54 cavity separated by a rib 56 extending between the first 44 and second 46 walls. FIG.4 shows a first 52, second 54, and third cavity 58, each separated from one, or both, of the others by a rib(s) 56 extending between the first 44 and second 46 walls. All of the cavities 52,54,58 include internal radii 60.

The airfoil 30 is extruded from discontinuously reinforced aluminum (DRA). Preferably, the DRA comprises a base 2000, 6000, or 7000 series aluminum alloy matrix, as defined by the Aluminum Association. In the most preferred embodiment, the DRA comprises a 6000 series aluminum alloy matrix. The reinforcing agent of the DRA may be any one of the following elements: SiC, $Al_2O_3$, $B_4C$, BeO, $TiB_2$, $Si_3N_4$, AlN, MgO, $ZrO_2$. The preferred group of reinforcing elements includes SiC, $Al_2O_3$, $B_4C$ in particulate form. The most preferred reinforcing element is SiC in particle form, five (5) to ten (10) microns in size. The volume percent of the reinforcing agent within the DRA will depend upon the series aluminum alloy matrix and the reinforcing element used. In the case of SiC as the reinforcing agent, the preferred range of volume percent is at least 10 and no more than 30 volume percent of SiC particulate in a 6000 series aluminum alloy matrix DRA. Within that preferred range, improved extrusion results were achieved by maintaining a volume percent range of at least 15 and no more than 20 volume percent of SiC in a 6000 series aluminum alloy matrix DRA. The best extrusion results were attained using a 17.5 volume percent of SiC in a 6000 series aluminum alloy matrix DRA.

During the extrusion process of the preferred embodiment, the 6000 series aluminum alloy matrix DRA having 17.5 volume percent SiC as a reinforcing element is extruded into a two cavity 52,54 airfoil cross-section (see FIG.3) using a porthole die having a pair of mandrels supported by appendages. The die is made of a titanium carbide reinforced steel, for example "SK grade Ferrotic" produced by Alloy Technology International, Incorporated, of West Nyack, N.Y., USA. The mandrels are disposed in the middle of the die and DRA is forced to flow around the mandrels, separating at the appendages. Aft of the mandrels, the extruded metal separated by the appendages joins back together in metal-metal bonds. This process is sometimes referred to as "welding". The voids created by the mandrels remain and become the cavities of the airfoil. The titanium carbide reinforced die produces a satisfactory finish on the extruded airfoil. The extruded strip of DRA is subsequently cut to length and finished as is necessary for the application at hand.

A significant advantage of the present invention is that an airfoil 30 having the requisite stiffness can be inexpensively formed having minimal diameter external 62 and internal 60 radii. Minimal external radii 62 along the leading 48 and trailing 50 edges are advantageous for aerodynamic purposes. Minimal internal radii 60 are advantageous because smaller internal radii permit a greater degree of hollowness in most airfoils 30 and therefore a lighter airfoil.

Although this invention has been shown and described with respect to the detailed embodiments thereof, it will be understood by those skilled in the art that various changes in form and detail thereof may be made without departing from the spirit and the scope of the invention. For example, the Best Mode for Carrying Out the Invention disclosed heretofore, has discussed the present invention airfoil using the example of a FEGV. The airfoil of the present invention may be used in other applications alternatively.

We claim:

1. An airfoil, comprising:

a cross-sectional geometry which includes a first wall and a second wall disposed opposite said first wall, a leading edge and a trailing edge, and a first cavity disposed between said first and second walls, and said leading and trailing edges;

a first end and a second end, said cross-sectional geometry extending between said first and second ends; and wherein said airfoil is extruded from discontinuously reinforced aluminum, and said discontinuously reinforced aluminum includes at least 10 volume percent of silicon carbide as a reinforcing element, and no more than 30 volume percent of silicon carbide as said reinforcing element.

2. An airfoil according to claim 1, wherein said discontinuously reinforced aluminum includes a 6000 series aluminum alloy matrix.

3. An airfoil according to claim 2, wherein said discontinuously reinforced aluminum includes between 15 and 20 volume percent of silicon carbide as said reinforcing element.

4. An airfoil according to claim 3, wherein said discontinuously reinforced aluminum includes 17.5 volume percent of silicon carbide as said reinforcing element.

5. An airfoil according to claim 4, wherein said cross-sectional geometry further comprises:

a second cavity; and a rib, extending between said first and second walls, said rib separating said first and second cavities.

6. An airfoil according to claim 5, wherein said airfoil is a fan exit guide vane.

7. An airfoil according to claim 1, wherein said discontinuously reinforced aluminum includes between 15 and 20 volume percent of silicon carbide as said reinforcing element.

8. An airfoil according to claim 7, wherein said discontinuously reinforced aluminum includes 17.5 volume percent of silicon carbide as said reinforcing element.

9. An airfoil according to claim 1, wherein said cross-sectional geometry further comprises:

a second cavity; and a rib, extending between said first and second walls, said rib separating said first and second cavities.

10. An airfoil according to claim 9, wherein said discontinuously reinforced aluminum includes a 6000 series aluminum alloy matrix.

11. An airfoil according to claim 10, wherein said discontinuously reinforced aluminum includes at least 15 volume percent of silicon carbide as a reinforcing element, and no more than 20 volume percent of silicon carbide as a reinforcing element.

12. An airfoil according to claim 11, wherein said airfoil is a fan exit guide vane.

13. A fan exit guide vane assembly, comprising:

a plurality of guide vanes, each extruded from discontinuously reinforced aluminum having at least 10 volume percent of silicon carbide as a reinforcing element, and no more than 30 volume percent of silicon carbide as said reinforcing element, and each guide vane having first and second ends, a cavity, a leading edge, and a trailing edge;

an outer case;

an inner case, disposed radially inside of and substantially concentric with said outer case;

wherein said guide vanes extend between said inner and outer cases, and are circumferentially distributed between said inner and outer cases.

14. A fan exit guide vane assembly according to claim 13, wherein said discontinuously reinforced aluminum comprises a 6000 series aluminum alloy.

15. A fan exit guide vane assembly according to claim 14, wherein said discontinuously reinforced aluminum comprises at least 15 volume percent of silicon carbide as said reinforcing element, and no more than 20 volume percent of silicon carbide as said reinforcing element.

16. A fan exit guide vane assembly according to claim 15, wherein said discontinuously reinforced aluminum comprises 17.5 volume percent of silicon carbide as said reinforcing element.

17. An airfoil, comprising:

a cross-sectional geometry which includes a first wall and a second wall disposed opposite said first wall, a leading edge and a trailing edge, and a first cavity disposed between said first and second walls and said leading and trailing edges;

a first end and a second end, said cross-sectional geometry extending between said first and second ends; and wherein said airfoil is extruded from discontinuously reinforced aluminum, and said discontinuously reinforced aluminum includes a 6000 series aluminum alloy matrix and silicon carbide as a reinforcing element.

18. An airfoil, comprising:

a cross-sectional geometry which includes a first wall and a second wall disposed opposite said first wall, a leading edge and a trailing edge, and a first cavity disposed between said first and second walls and said leading and trailing edges;

a first end and a second end, said cross-sectional geometry extending between said first and second ends; and wherein said airfoil is extruded from discontinuously reinforced aluminum, and said discontinuously reinforced aluminum includes a 6000 series aluminum alloy matrix and a reinforcing element selected from the group consisting of SiC, $Al_2O_3$, and $B_4C$.

* * * * *